US005771561A

United States Patent [19]

Hofele

[11] Patent Number: 5,771,561

[45] Date of Patent: Jun. 30, 1998

[54] CONVERTIBLE MULTISTATION PRESS

[75] Inventor: Hans Hofele, Goeppingen, Germany

[73] Assignee: Schuler Pressen GmbH & Co., Germany

[21] Appl. No.: 748,581

[22] Filed: Nov. 13, 1996

[30] Foreign Application Priority Data

Nov. 13, 1995 [DE] Germany ..... 195 42 203.1

[51] Int. Cl.[6] ..... B23Q 5/22; B21D 43/05

[52] U.S. Cl. ..... 29/563; 72/405.13; 198/621.1

[58] Field of Search ..... 29/421.1, 563; 72/405.01, 405.05, 405.11, 405.13, 405.14; 414/752; 198/468.4, 621.1

[56] References Cited

U.S. PATENT DOCUMENTS

| | | | |
|---|---|---|---|
| 4,697,449 | 10/1987 | Harsch et al. | 414/751 X |
| 4,932,235 | 6/1990 | Rieger et al. | 198/621.1 |
| 5,001,921 | 3/1991 | Schneider et al. | 72/405.13 |
| 5,097,695 | 3/1992 | Brzezniak | 72/405.13 |
| 5,140,839 | 8/1992 | Bruns | 72/405.1 |
| 5,248,288 | 9/1993 | Kamiya et al. | 483/28 |
| 5,473,927 | 12/1995 | Brandstetter et al. | 72/405.14 |
| 5,595,087 | 1/1997 | Harsch | 72/405.16 |
| 5,617,756 | 4/1997 | Thudium et al. | 72/405.13 X |

FOREIGN PATENT DOCUMENTS

| | | | |
|---|---|---|---|
| 616859 | 9/1994 | European Pat. Off. | 72/405.13 |
| 36 07 323 C2 | 11/1986 | Germany . | |
| 36 34 756 A1 | 6/1987 | Germany . | |
| 38 43 975 C1 | 6/1990 | Germany . | |
| 43 09 643 A1 | 9/1994 | Germany . | |

*Primary Examiner*—William R. Briggs
*Attorney, Agent, or Firm*—Evenson, McKeown, Edwards & Lenahan, P.L.L.C.

[57] ABSTRACT

A multistation press has a three-axis transfer provided with transport rails onto which carrier rails are placed. The carrier rails carry grippers for the workpieces. During the tool change, the carrier rails are deposited on corresponding receiving devices of the sliding table. The transport rail is at first moved to deposit a first carrier rail connected therewith on the receiving device. Then the transport rail is separated from the carrier rail and is moved to bring a second carrier rail still connected therewith to the receiving device. The receiving device receives the second carrier rail in the immediate vicinity of the first carrier rail, whereby two carrier rails overlap and are spaced closely side-by-side. The receiving device is then laterally swivelled away. The carrier rails are deposited on the receiving device without the aid of driving devices operating between the transport rail and the carrier rail.

15 Claims, 11 Drawing Sheets

CONVERTIBLE MULTISTATION PRESS

BACKGROUND AND SUMMARY OF THE INVENTION

The present invention relates to a multistation press having several press stations arranged behind one another corresponding to a machining sequence.

Multistation presses are frequently constructed as an individual machine or as a system of presses which are directly linked with one another. This is particularly so if they operate in a given cycle in a mutually coordinated manner and are linked with one another by a transfer system which transports workpieces from one press station to the next. In this known type of press, the press stations are provided with tools which are set up for the respective workpiece type to be machined. Gripper devices are also provided on the transfer system for the special workpiece to be machined and to be transported.

If multistation presses are constructed for the machining of a special workpiece or are converted from the machining of one workpiece to the machining of another workpiece, the workpiece-specific parts of the press stations and of the transfer system must be exchanged. This should take place as fast and automatically as possible.

DE 38 43 975 C1 describes a transport device for larger workpieces for a transfer press. The transfer press has several press stations which are arranged along a transport direction, are spaced away from one another and in which bottom dies or bottom tools provided for receiving the workpieces are exchangeably arranged on sliding tables. Above the sliding tables, slides are provided which can be moved vertically up and down and which are driven synchronously. Each slide is equipped with a top tool and, together with the bottom tool arranged on the sliding table, defines a press station.

For the known workpiece transport, a cross-traverse transfer device is arranged between the press stations and has two mutually parallel transport rails. The transport rails are guided on both sides of the press stations along the entire length of the transfer press and are connected with one another by cross-traverses. Coupling devices detachably couple the cross-traverses are detachably connected with the transport rails. Between the press stations, so-called rig pins are arranged which are each connected in pairs with a sliding table and are used for receiving the cross-traverses to be exchanged. For the conversion, i.e., for exchanging the workpiece-specific parts of the press, the cross-traverses are deposited on the rig pins and are moved by the sliding tables laterally out of the press.

During the construction of this press, care must be taken that also the rig pins, which are arranged between the sliding tables and are each connected with a sliding table, can be moved laterally out of the press. For this reason, neither sliding tables nor rig pins connected with them can be arranged in the column area.

DE-PS 36 07 323 describes a press working line with individual presses in which the workpiece transport is carried out by gripper rails. To permit an automatic converting operation, the presses are equipped with sliding tables which can be moved in and out through the press columns of the press transversely to the transport direction of the parts. The respective sliding table permit the exchange of the tools which are used for machining the workpieces. The gripper rails provided for the transfer have part-related gripper rail parts which are each set up for the transport of the special part to be transported.

An exchange of these gripper rail parts is permitted by dividing each of the gripper rail parts into three parts which are detachably connected with the gripper rail. The gripper rail parts are equipped with the grippers which must be engaged with the respective workpiece while the continuous sections of the gripper rails are used only as supports for the gripper rail parts. The gripper rail parts are formed by one center part respectively as well as two exterior adjoining parts. Relative to the respective center part, the exterior parts are telescopically displaceable and are driven by piston-cylinder units.

For exchanging the gripper rail parts, the exterior parts are adjusted by the piston-cylinder units in the direction of the center part, after which the gripper rail parts forming a unit are deposited on a corresponding receiving device of the sliding table and are moved out of the press. The considerable weight of the gripper rails and of the piston-cylinder units driving them disadvantageously increases the weight of the gripper rails.

U.S. Pat. No. 5,248,288 describes a transfer press system which has several linked successive press stations by a cross-traverse transfer device. The cross-traverse transfer device has two parallel transport rails which are driven synchronously. Between the transport rails, cross-traverses are suspended transversely to the transport direction and are detachably connected with the transport rails by coupling devices. In each press station, a sliding table is provided by which the deforming tools can be moved laterally out of the press area. Each sliding table is equipped with a receiving device for cross-traverses detached from the transport rods which is arranged in a space defined by the adjacent sliding table. This receiving device contains two telescopic cylinders which, by way of a lever parallelogram, can be swivelled in parallel to the sliding table and can be height adjusted.

For the tool change, the receiving device takes the cross-traverses off the transport rails and folds the cross-traverses against the workpieces situated on the sliding table in order to achieve a compact arrangement of the tools to be exchanged. This manner of exchanging the gripper devices and the tools requires a transfer system with cross-traverses which requires spaces between the sliding tables.

DE 43 09 643 A12 describes a transfer device for the workpiece transfer which is constructed as a three-axis transfer. The transfer device is provided on a press with several press stations and has two transport rails extending at a distance parallel along the entire press length. These transport rails are synchronously moved in and against the transport direction, and are lifted and lowered as required by way of corresponding lifting devices. In addition, the transport rails can be moved toward and away from one another. The transport rails support carrier rails equipped with workpiece gripping devices. Depositing supports for receiving carrier rails are provided on each sliding table. In order to separate the carrier rails from the transport rails and place them on the depositing devices, particularly carrier rails situated in the column area are moved by the transport rails out of the column area and into the corresponding depositing position at the sliding tables and are deposited in a mutually aligned manner. In this position, the carrier rails with the sliding tables and the tools deposited thereon can be moved laterally out of the press.

Particularly in the case of presses with several columns which stand relatively close to one another, the passages required for the lateral moving out of the sliding tables are relatively limited with respect to their dimensions, and this can present problems.

It is an object of the present invention to provide a multistation press with a transfer device in which tools used for machining the workpieces, as well as gripper devices used for the transport of the workpieces and provided on the transfer device, can be automatically and simply exchanged without the requirement of additional space for moving the transport rails or for the lateral moving out of the sliding tables.

It is another object of the present invention to provide a process for changing the gripper devices during a tool change which meets the above-mentioned requirements.

These objects have been achieved in accordance with the present invention by providing a multistation press having a plurality of press stations arranged behind one another corresponding to a machining sequence; sliding tables associated with respective ones of the press stations; a transfer device for transporting workpieces between the press stations in a transport direction, and having at least two transport rails; a driving device for driving the transport rails to carry out a transfer movement; carrier devices detachably connected in a mutually spaced manner with the transport rails and provided with gripper devices; and at least one receiving device provided on the sliding table and arranged for connecting with the carrier devices, and for holding at least two separate carrier devices in spaced relationship to one another, wherein the carrier devices have a smaller distance from one another with respect to the distance on the transport rails.

In addition, the objects are achieved by a process for changing tools and gripper devices in press systems provided with sliding tables and with a workpiece transfer system, in which the workpiece transfer system has transport rails detachably connected with mutually separate carrier devices carrying gripper devices, comprising the steps of bringing a receiving device provided on the sliding table to the sliding table in a movement directed laterally to a transport direction defined by the workpiece flow; bringing the carrier device to a receiving point of the receiving device by a movement of the transport rail to be coupled therewith; detaching the transport rail from the carrier device which is now carried by the receiving device; bringing another carrier device to another receiving point of the receiving device by another movement of the transport rail to be coupled therewith, whereby the receiving points are adjacent each other; detaching the transport rail from the another carrier device which is now carried by the receiving device; moving the receiving device away by the sliding table; and moving the sliding table, which carries the tool and the carrier device, laterally out of a working range of the press system.

The multistation press of the present invention which may be an individual machine or a sequence of several presses linked with one another by the transfer device, is provided with sliding tables which can be moved laterally out of the press and permit a quick tool change. The transfer device has two mutually parallel transport rails which support mutually spaced carrier devices which, in turn, are provided with gripper devices for the workpieces. The carrier devices can be detached from the transport rails, with receiving devices for receiving the carrier rails are arranged on the sliding tables.

The carrier devices are each arranged on the transport rails in a mutually spaced manner, and the receiving devices of the sliding tables are constructed such that the carrier devices can be deposited close to one another, in which case they are not aligned with one another. Two carrier devices which are mutually adjacent on the transport rail carry out a longitudinal stroke during the transfer movement which longitudinal stroke corresponds to their respective own length plus the distance to the respective next adjacent carrier device.

Both carrier devices can be housed on the sliding table in an area whose longitudinal course measured in the transport direction does not exceed the stroke width and is preferably maximally as long as a single carrier device. This can be achieved particularly by an overlapping arrangement of the carrier devices in that these are, for example, stacked above one another. Such a housing of the carrier devices permits the receiving of additional carrier devices which will be required particularly if intermediate depositing devices are arranged between the sliding tables. Each transport rail will then support two carrier devices per sliding table.

As a result of the receiving of the carrier devices on the sliding tables which saves space in the longitudinal direction, carrier devices situated in the column area are movable by a longitudinal stroke movement of the transport rails out of the column area to be deposited on corresponding holding devices of the sliding table in a mutually overlapping manner. A sliding table can receive on each side, for example, two carrier devices arranged above one another which do not project beyond the sliding table. It can, therefore, be moved without any problems laterally out of the press area even if the passage provided for this purpose is restricted by adjacent press columns.

Furthermore, no devices are required for providing the carrier devices with a longitudinal movement with respect to the transport rails. Thereby, the mass of the carrier devices and transport rails and thus the occurring accelerating and braking forces remain within limits. This is a particular advantage in view of the transport rail driving device.

A particularly space-saving arrangement of the carrier devices on the sliding tables is obtained if the carrier devices are parallel to one another, either next to one another or above one another. If, in this case, the carrier devices each have a low height, the vertical adjustability of the transport rail, which exists anyhow, will be sufficient for depositing the carrier device on the receiving devices. This preferably takes place without providing driving devices on the carrier devices. That is, the carrier devices have a purely passive construction which keeps their weight comparatively low.

For fastening the carrier rail on the transport rail, a locking device is preferably arranged to act between them and has the purpose of coupling the gripper devices during the normal operation of the transfer device, i.e., during the workpiece transfer, stationarily to the transport rails. As soon as the carrier device is received by the receiving device and is form-lockingly connected therewith, the locking device will change into the release position. As a result of a suitable longitudinal movement, the transport rail can detach and separate from the carrier device.

The receiving device, which can, for example, also be rigid, is preferably swivellably disposed at the sliding table. Thereby, after the transfer of the carrier devices has taken place, the receiving device can be laterally swivelled away so that the gripper devices can be moved out of the tool range and the carrier devices can be moved out of the moving range of the transport rail.

The transfer unit which is formed by the transport rails of the driving unit and the gripper devices is preferably constructed as a three-axis transfer. The transport rails are arranged parallel to one another as well as parallel to the transport direction and can be moved in, the transport direction; i.e., horizontally, vertically as well as toward and away from one another. In such a three-axis transfer, the transferring of the carrier devices held by the transport rails to the corresponding receiving devices on the sliding tables can be carried out in a particularly simple manner using the three-axis transfer for the fetching and the suspending of the carrier devices in the receiving devices without the aid of additional driving units.

A transport rail allows the first one of the carrier devices received by the holding device to be first inserted into the holding device by a lateral depositing movement. Thereafter, the transport rail is separated from the carrier device preferably by a combined advancing/lowering movement. Then the transport rail brings the additional carrier device to be connected with the holding device and deposits it thereon. The carrier devices can be held close to one another and therefore held in a very space-saving manner on the sliding table.

BRIEF DESCRIPTION OF THE DRAWINGS

These and other objects, features and advantages of the present invention will become more readily apparent from the following detailed description of currently preferred embodiments when taken in conjunction with the accompanying drawings wherein.

DETAILED DESCRIPTION OF THE DRAWINGS

Figure 1:
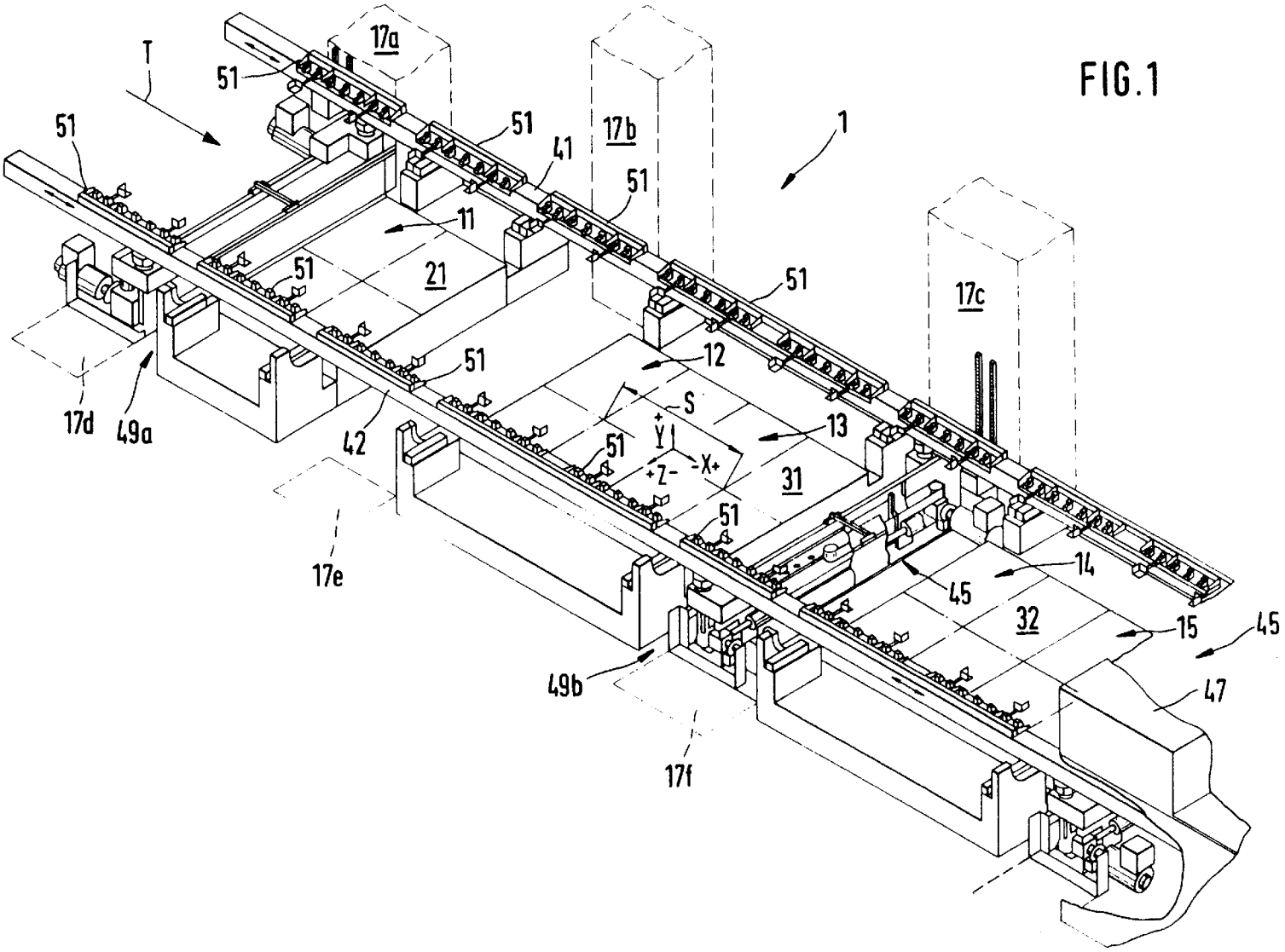
FIG. 1 is a schematic, partially cutaway perspective view of a multistation press with a three-axis transfer, having two mutually parallel transport rails in accordance with the present invention.

The multistation press 1 shown in FIG. 1 has five press stations 11, 12, 13, 14, 15 arranged behind one another along a transport direction T. The multistation press 1 is shown cutaway and its machine frame is outlined by press columns 17 which are erected on both sides of the workpiece transport path determined by the transport direction T in one row, respectively. For differentiation purposes, the press columns 17 are, in addition, marked by means of a letter a to f, respectively, with the press columns 17*d*, 17*e*, 17*f* arranged on the right side of the transport path being shown only by a planar outline. The machine frame indicated by the press columns 17 carries, among other things, slides which are not described any further and which can be synchronously moved up and down. One slide respectively is assigned to each press station 11, 12, 13, 14, 15. Such a slide 19 is outlined, for example, in FIG. 3 for the press station 11.

As illustrated in FIG. 1, each of the press stations 11, 12, 13, 14, 15 is arranged in areas of the transport path T in which no press columns 17 are situated. Press station 11 is, for example, arranged between the press columns 17*a*, 17*b*, 17*d*, 17*e*, while press stations 12, 13 are arranged between the press columns 17*b*, 17*c*, 17*e*, 17*f*.

Figure 3:
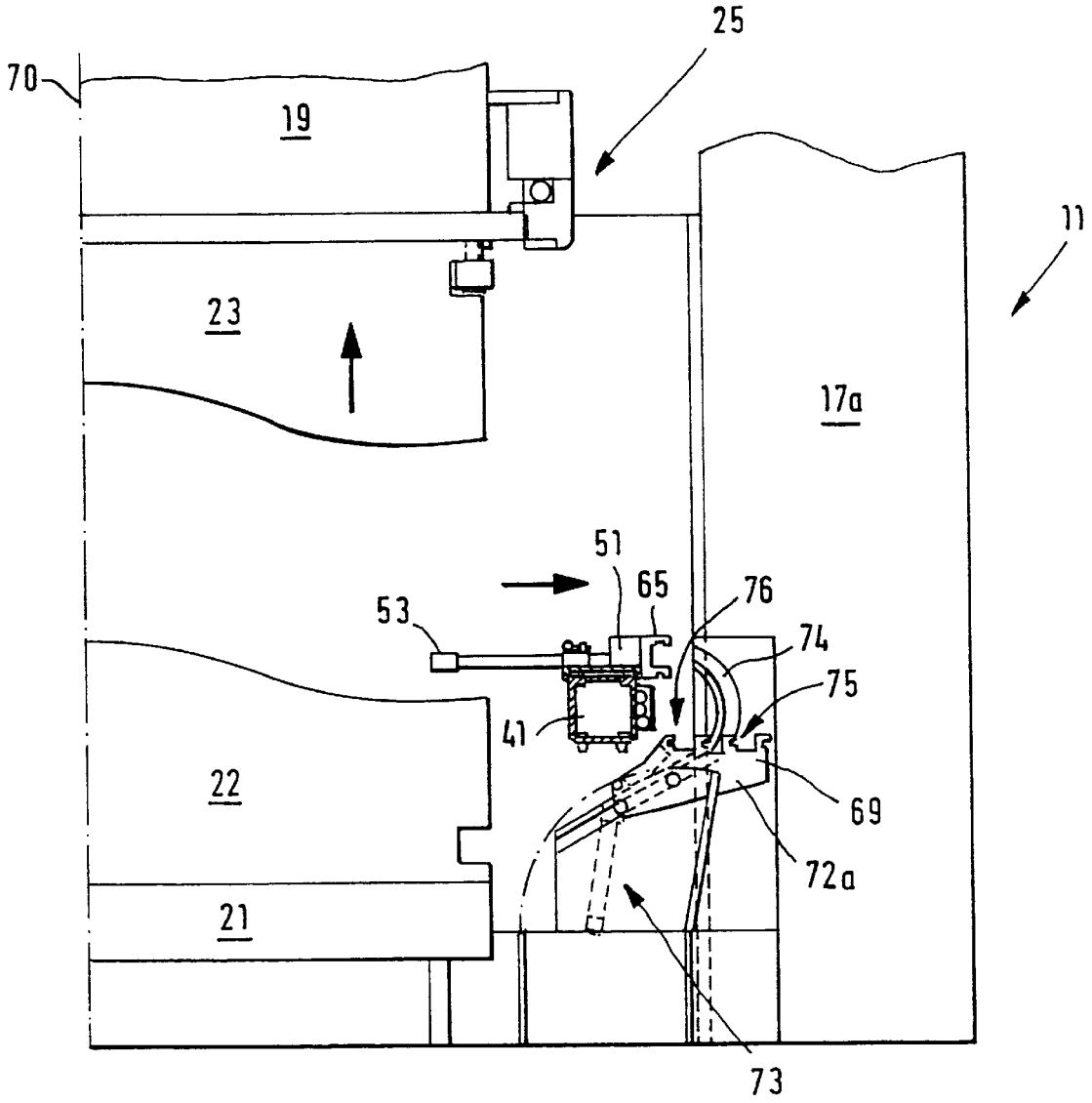
FIG. 3 is a schematic cross-sectional view of a press station with a sliding table which has a receiving and holding device for carrier rails.

Press station 11 has a sliding table 21 which is disposed in a stationary manner and is setup to receive a bottom tool 22 arranged below the slide 19 as seen in FIG. 3. A top tool 23 is suspended on the slide 19 moving toward and away from the bottom tool 22. For this purpose, coupling devices 25 are used which can be detached as required.

In a corresponding manner, the bottom tools of the press stations 12, 13 are arranged on a common sliding table 31 and the bottom tools of the press stations 14, 15 are arranged on a sliding table 32 as seen in FIG. 1. The sliding tables 21, 31, 32 permit a lateral moving-out from the press area in order to be able to exchange, for example, the bottom tool 22 connected with the sliding table and the top tool 23 disposed thereon.

For transporting workpieces along the transport direction T through all press stations 11, 12, 13, 14, 15, a transfer device 35 is provided which is constructed as a three-axis transfer. The transfer device has a pair of parallel transport rails 41, 42, each of which extends in the proximity of the columns along the entire length of the multistation press 1 and which are arranged parallel to the transport direction T. The transport rails 41, 42 can be moved by a driving device 45 in the X-direction coinciding with the transport direction T as well as in the vertical or Y-direction and transversely in the Z-direction to the transport direction T.

For the transport rails 41, 42, the transport device 45 contains a linear drive 47 which is connected on the end side with the transport rail 41, 42 and which is separately controllable. The linear drive 47 provides a longitudinal movement in and against the X-direction to the transport rails independently of their stroke position or their distance to one another.

Driving units 49*a*, 49*b*, which are connected with the transport rails 41, 42 by linear guides, also comprise the transport device 45. The driving units 49*a*, 49*b* are constructed as so-called "closing boxes" and adjust the transport rails 41, 42 in their distance to one another in the Z-direction and in the height or Y-direction. The closing boxes 49*a*, 49*b* are arranged in the column area where no sliding tables are arranged in any event. Intermediate depositing positions for the workpieces are provided above the closing boxes. This also applies to the space between the press stations 11, 12; here also, a workpiece depositing position is provided.

The transport rails 41, 42 are detachably connected with carrier rails 51 which are provided with grippers 53 extending away from the transport rail 41, 42. The grippers 52 extend essentially along the Z-direction and, by a targeted lateral movement of the respective transport rail 41, 42, are engaged with and disengaged from the workpiece disposed on the respective bottom tool, for example, the bottom tool 22 as seen in FIG. 3.

Because of the workpiece depositing positions between the sliding tables, the number of carrier rails 51 on the transport rail 41 exceeds the number of press stations 11, 12, 13, 14, 15 as is the case with the transport rail 42. The overall length of the carrier rails 51 therefore exceeds the width of the passages existing between the columns 17*a*, 17*b*, 17*c*.

Figure 2:
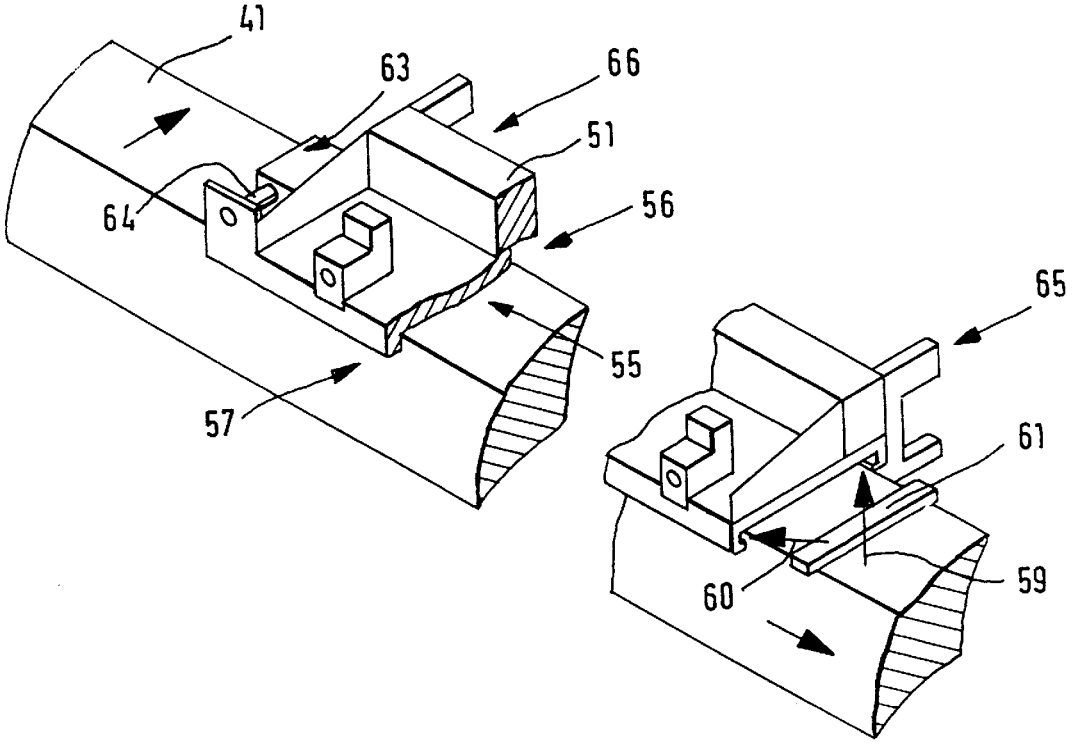
FIG. 2 is a schematic, cutaway perspective view of a transport rail with a carrier rail disposed thereon.

The carrier rails 51, of which one is illustrated as an example in FIG. 2, are flat stiffened carrier bodies situated on the transport rails 41, 42. The carrier rail 51 is disposed by its flat bottom side 55 on the top side of the carrier rail 41 and reaches via its lateral edges 56, 57 over the flanks of the transport rail 41. At least on the end side, the lateral edges 56, 57 each carry an inner groove 59, 60 into which a corresponding web 61 can engage which is firmly connected with the transport rail 41. On its other face, the carrier rail 51 is provided with a locking device 63 which stationarily locks the carrier 51 rail by a locking pin 64 on the transport rail 41.

On its side away from the grippers 53, the carrier rail 51 is equipped with form-locking couplings 65, 66 which can optionally be coupled to a receiving device 69 provided on the respective sliding table, for example, sliding table 22. Each sliding table is provided on its two sides with such a receiving device 69. Because of the symmetry of the multistation press 1 with respect to a plane of symmetry 70 in FIG. 3 extending longitudinally and vertically, only the side of the press station 11 need be illustrated which, viewed along the transport direction T, is situated on the right in FIG. 3.

Figure 4:
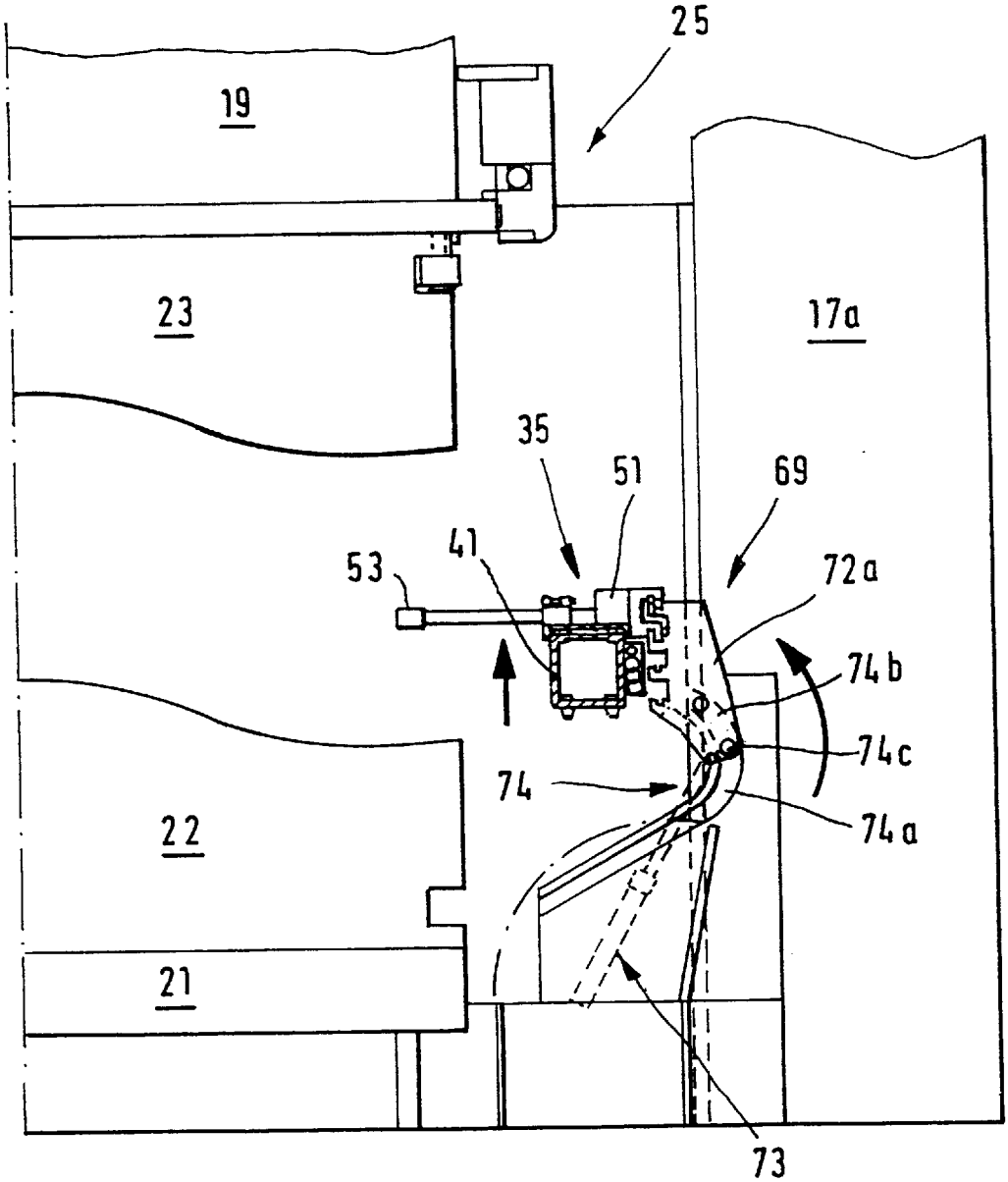
FIGS. 4 to 11 are schematic, cutaway cross-sectional views of the press station according to FIG. 3, illustrating different working steps of the tool change.

The receiving device 69 has two spaced swivel levers 72*a*, 72*b* which are arranged parallel to one another and which, by way of a pneumatic swivel device 73, are swivelled synchronously to one another into a first storage position illustrated in FIG. 3 and into a second receiving position illustrated in FIG. 4. For this purpose, the swivel levers 72*a*, 72*b* are disposed in a cam guide 74. For each swivel lever 72, the cam guide 74 has a guide groove 74*a* in which two pins 74*b*, 74*c* move. The guide groove is divided into a section rising in a straight line and extending toward the outside and also into a circular section. As a result, the swivel levers 72 carry out a combined lifting-swivelling and swivelling-lowering movement.

The receiving device 69 formed by the swivel levers 72*a*, 72 has two receiving points arranged above one another in the operating position, for the carrier rails 51, which are formed by complementary couplings 75, 76 which match the couplings 65, 66 of the carrier rails 51. The couplings 65, 66 connect the carrier rail 51 with the receiving device 69 in that it is suspended by its couplings 65, 66 into the complementary couplings 75, 76 and is form-lockingly connected therewith.

The tool and gripper exchange in the case of the multistation press 1 described so far is carried out in the following manner. In a first step illustrated in FIG. 3, the slide 19 is moved into its uppermost position and the transport rail 41 is adjusted such that a first carrier rail 51 to be deposited on the receiving device 69 of the sliding table 21 is situated in a defined starting position. In this starting position, the carrier rail 51 is in the press station 11.

In a second step, which is shown separately in FIG. 4, the swivel levers 72*a*, 72*b* are changed out of their horizontal position into a vertical position in which the complementary couplings 75, 76 provided on them arrive in the area of the couplings 65, 66 of the carrier rail 51. The couplings 65, 66 are situated at a narrow distance from the couplings 75, 76, that is, slightly higher than these couplings.

Figure 5:
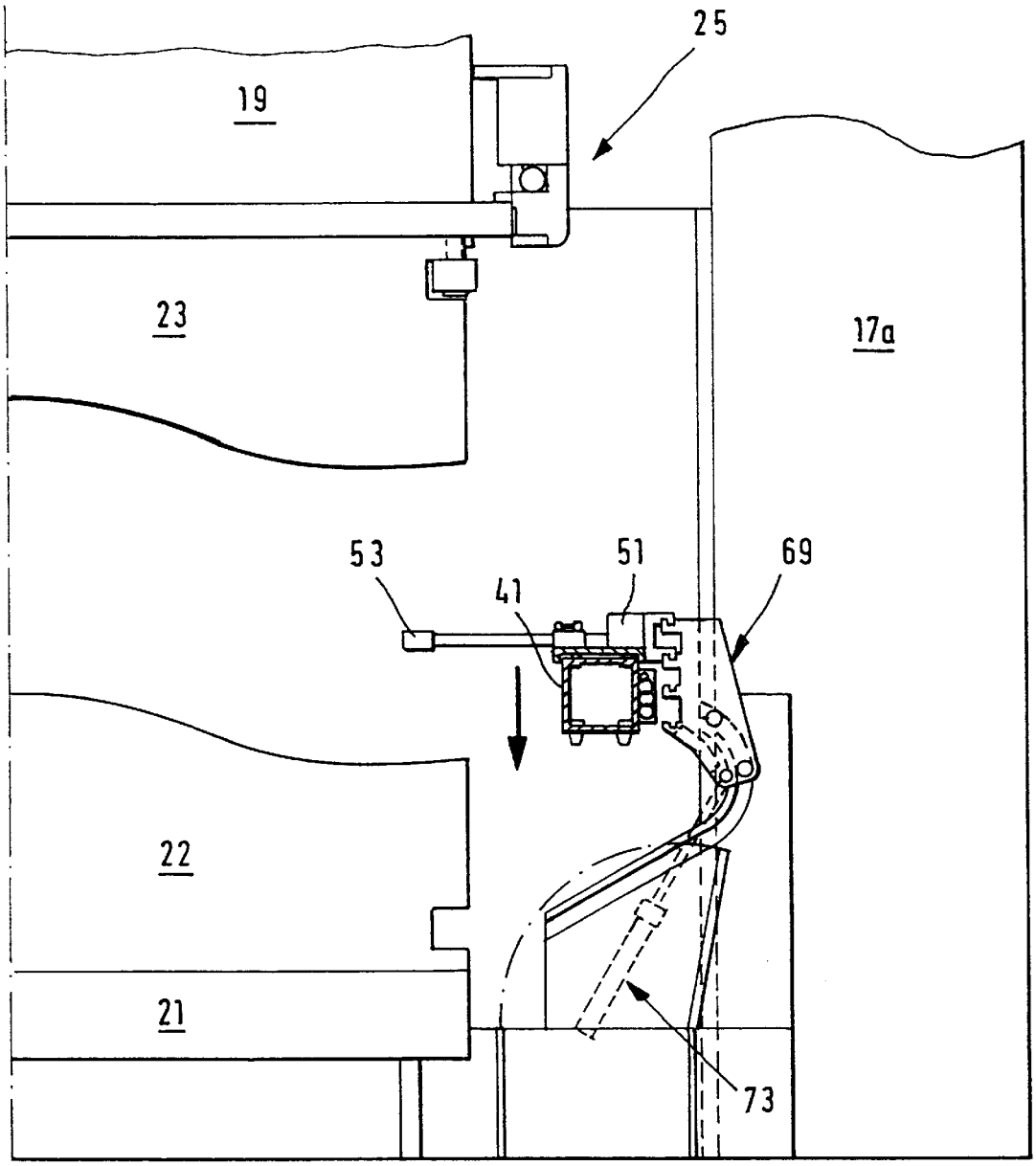

By way of a brief outward and lowering movement of the transport rail 41, the couplings 65, 66; 75, 76 are engaged with one another in the negative X- and Y-direction (i.e., opposite to the arrows shown in FIG. 1), whereby the carrier rail 51 is connected with the receiving device 69. The carrier rail 51 changes from the position illustrated in FIG. 4 into the position illustrated in FIG. 5.

Figure 6:
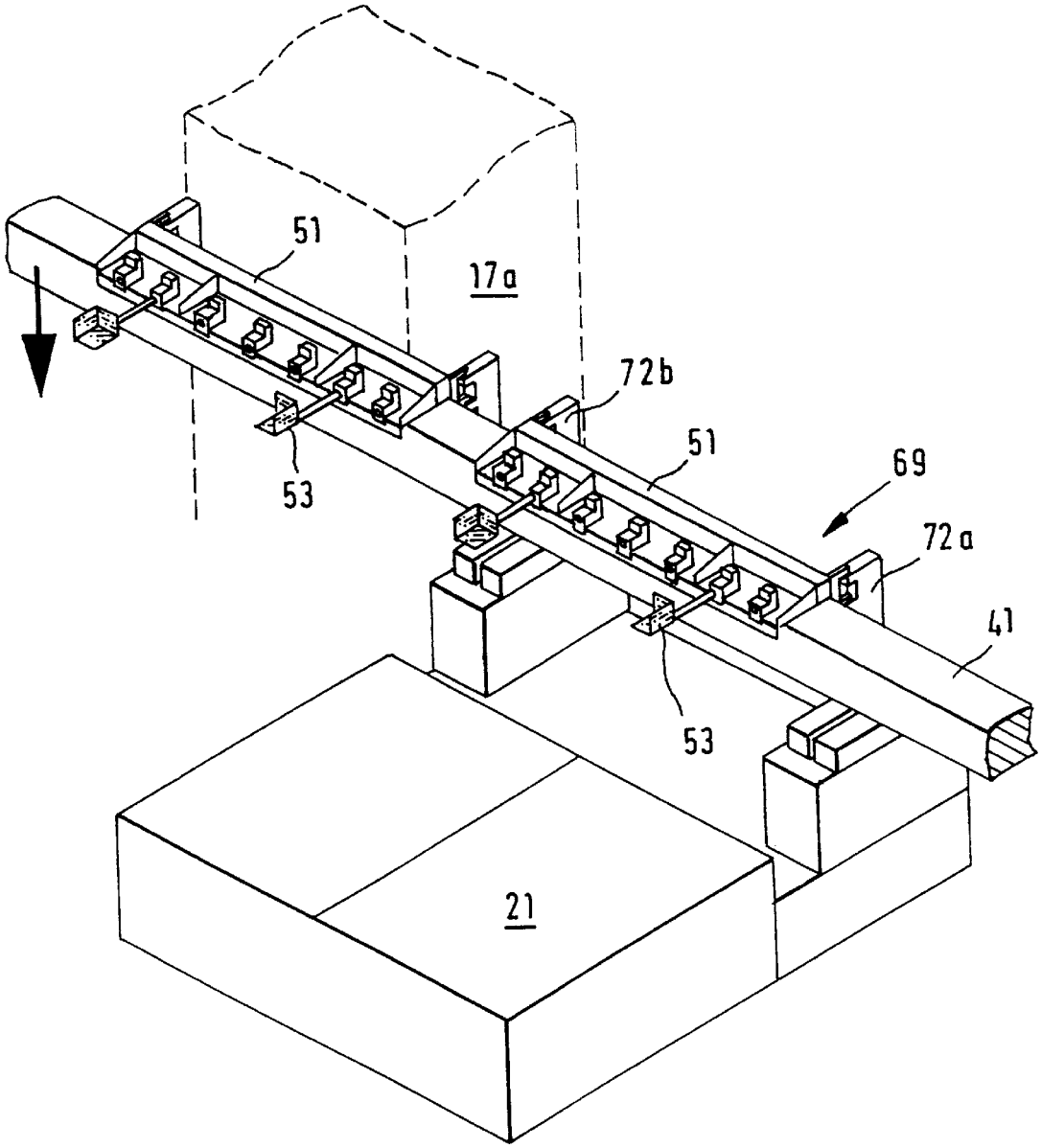

After the release of the locking pin 64 illustrated in FIG. 2, the transport rail 41 carries out a short longitudinal movement in the X-direction, whereby the web 61 leaves the grooves 59, 60 and the carrier rail 51 is detached. Then, as shown in FIG. 6, the transport rail 41 is lowered from its position illustrated in FIG. 5 by a thick solid arrow, and is moved by a complete stroke width S defined by the distance between two successive press stations 12, 13 into the transport direction T (X-direction) until the carrier rail 51 is situated precisely below the upper carrier rail 51 already connected with the receiving device 69 in the area of the press station 11.

Figure 7:
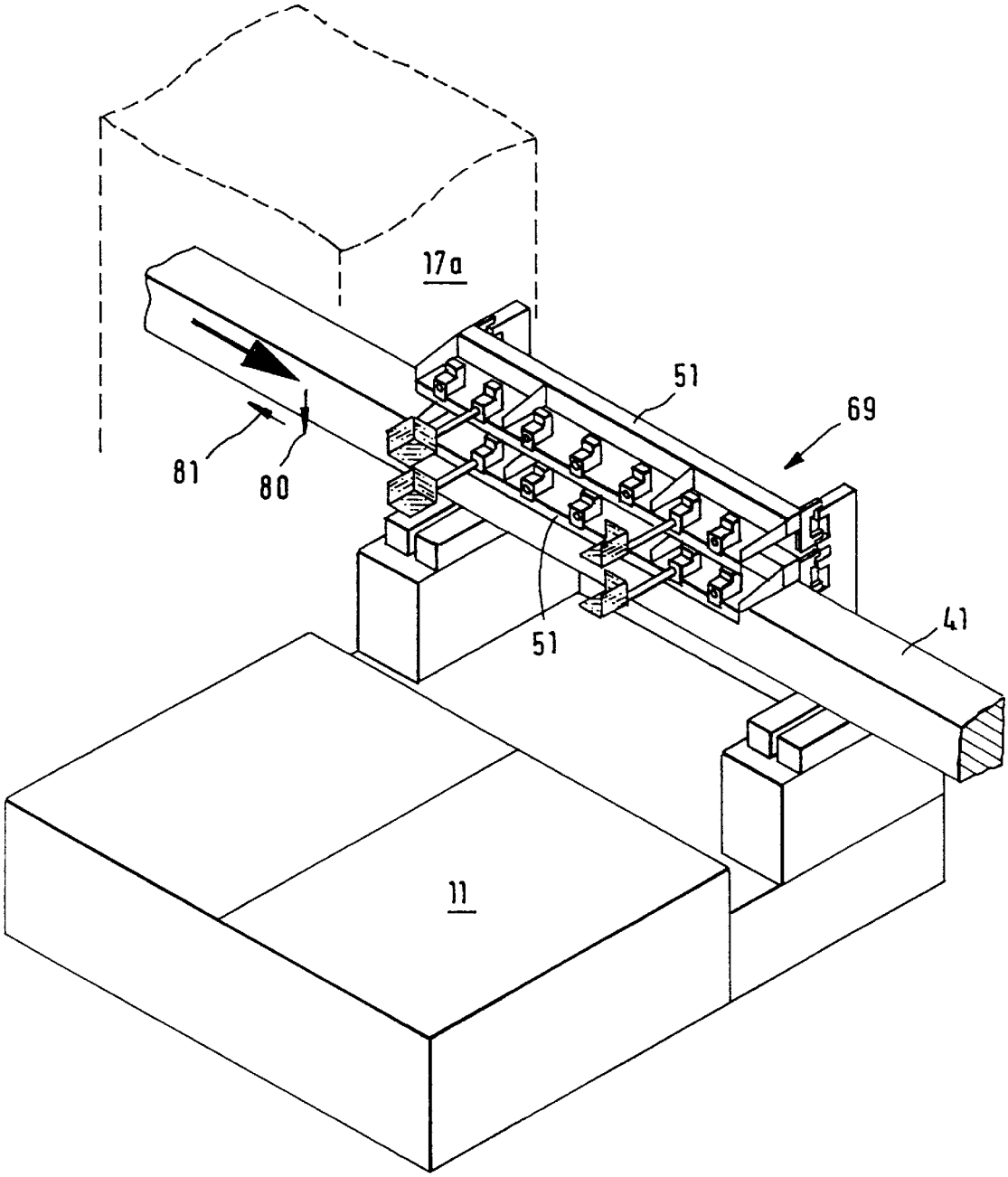
Figure 8:
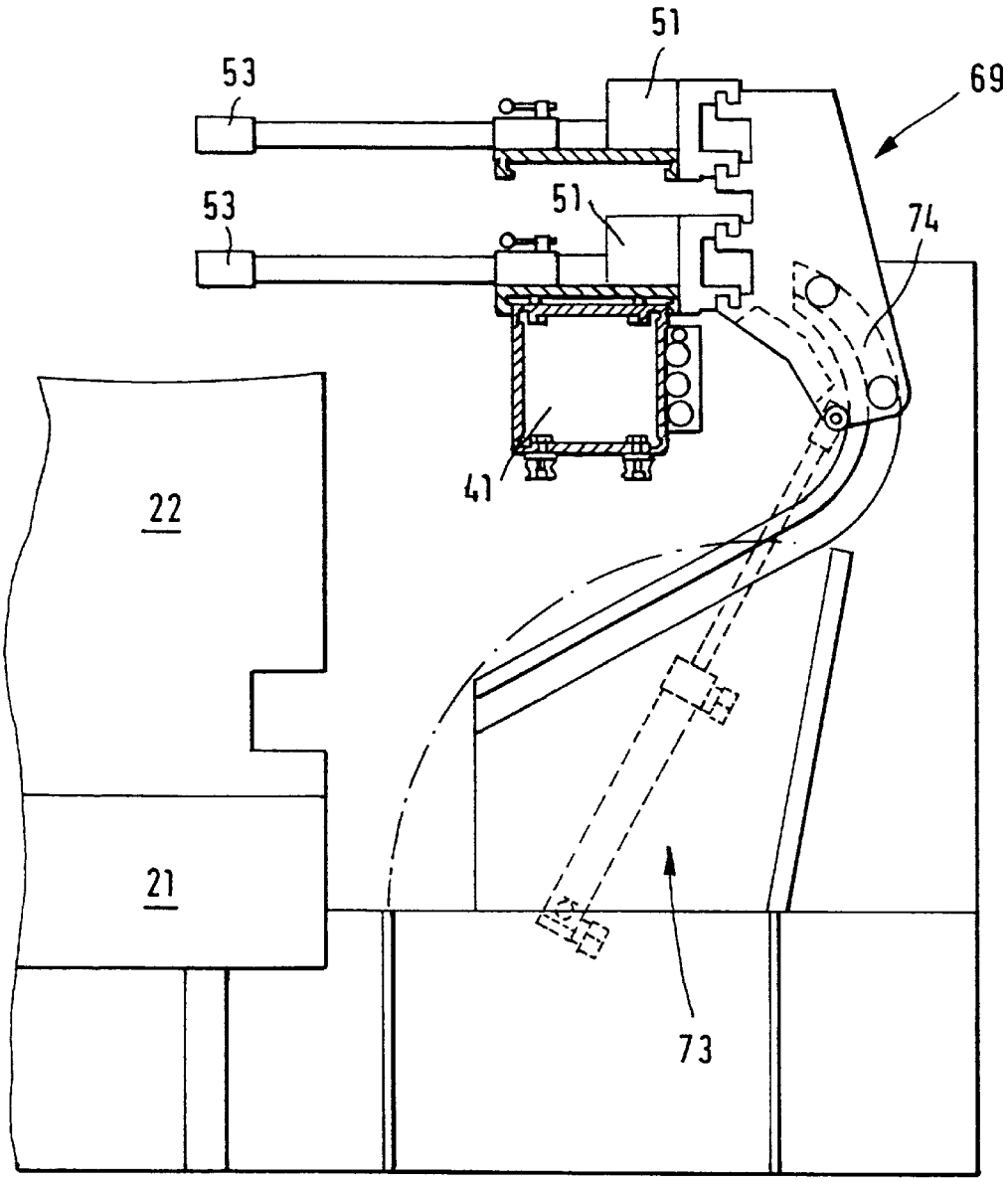

Then, as seen in FIG. 7, the transport rail 41 carries out a coupling movement outlined by an arrow 80 via which the lower carrier rail 51 is form-lockingly coupled to the receiving device 69. A shorter release movement, which is directed against the transport direction T and is represented by an arrow 81, as illustrated in FIG. 7, effects a separation of the transport rail 41 from the carrier rail 51. This condition is illustrated in FIG. 8 as viewed along the transport direction T. The deposition of the carrier rails 51 of the transport rail 42 on corresponding receiving devices takes place in a corresponding manner simultaneously and synchronously.

Figure 9:
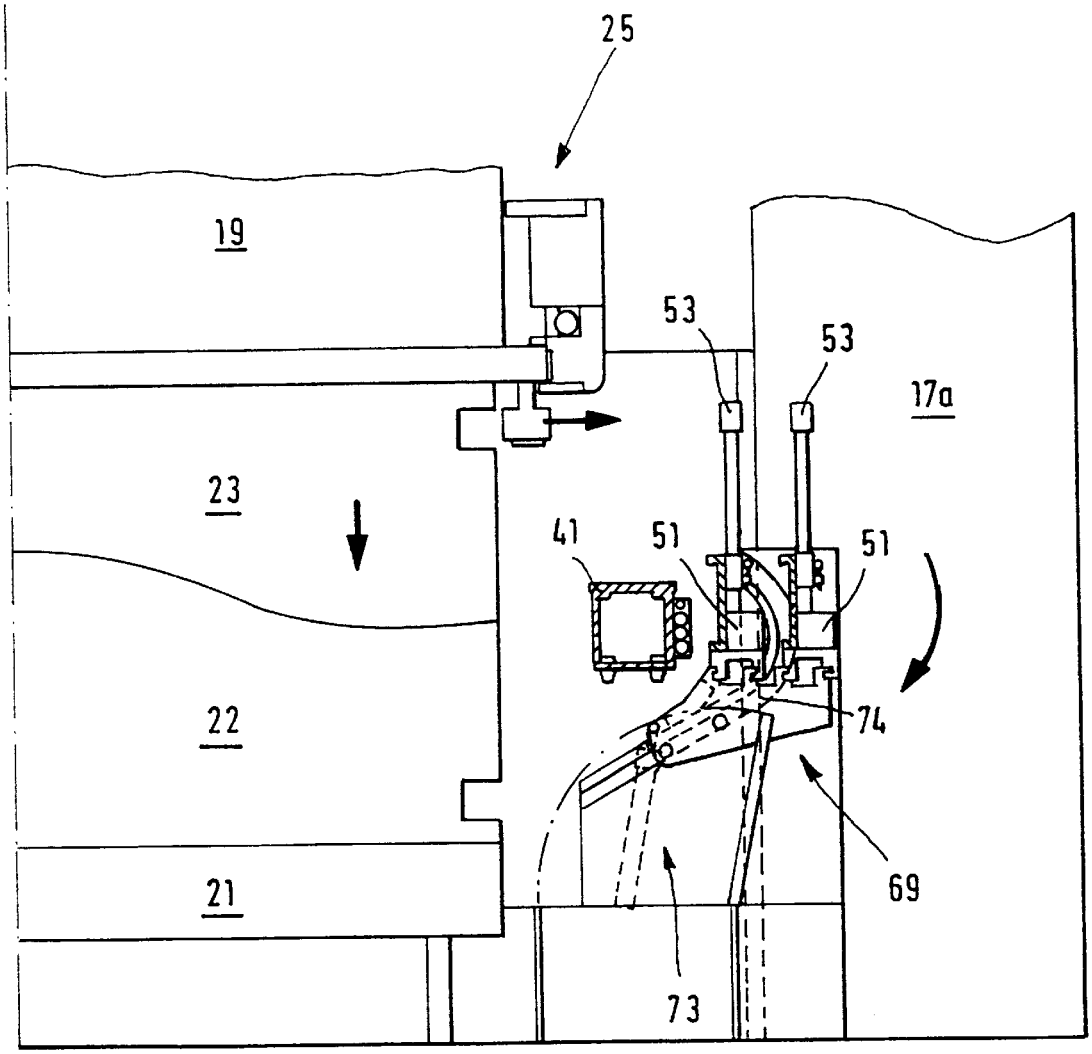

After the separation of the transport rails 41, 42 from the carrier rail 51, the receiving device 69 is changed into the storage position illustrated in FIG. 9 in that the pneumatic device 73 is actuated and the swivel levers 72*a*, 72*b* are moved in the cam guide 74. Thereby, the two carrier rails 51 received by the receiving device 69 are situated parallel to one another in a horizontal plane, and the grippers 53 are swivelled out of the tool area. Then the top tool 23 is placed on the bottom tool 22 by the lowering of the slide 19, and the coupling device 25 is released so that the top tool 23 is separated from the slide 19.

Figure 10:
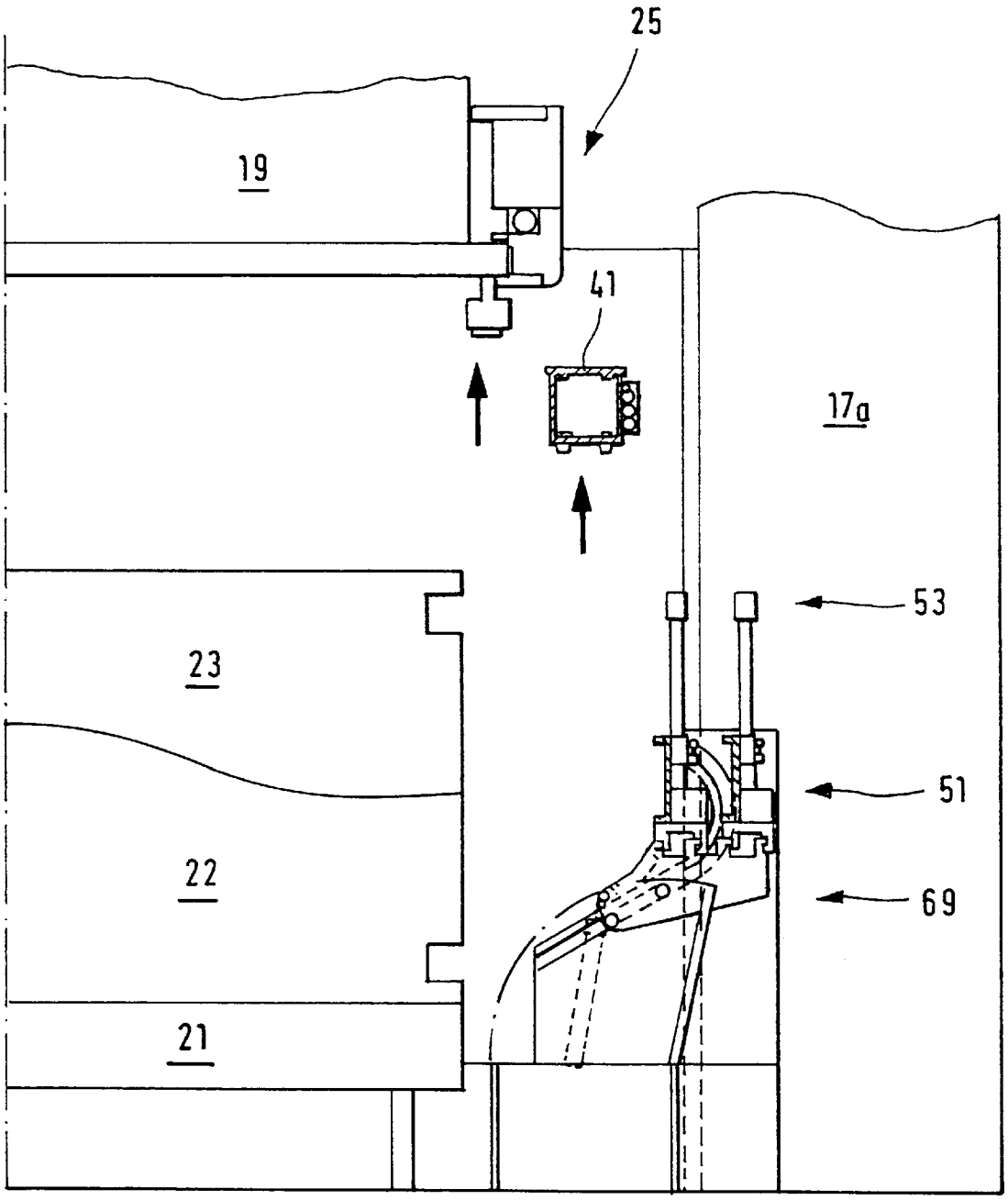
Figure 11:
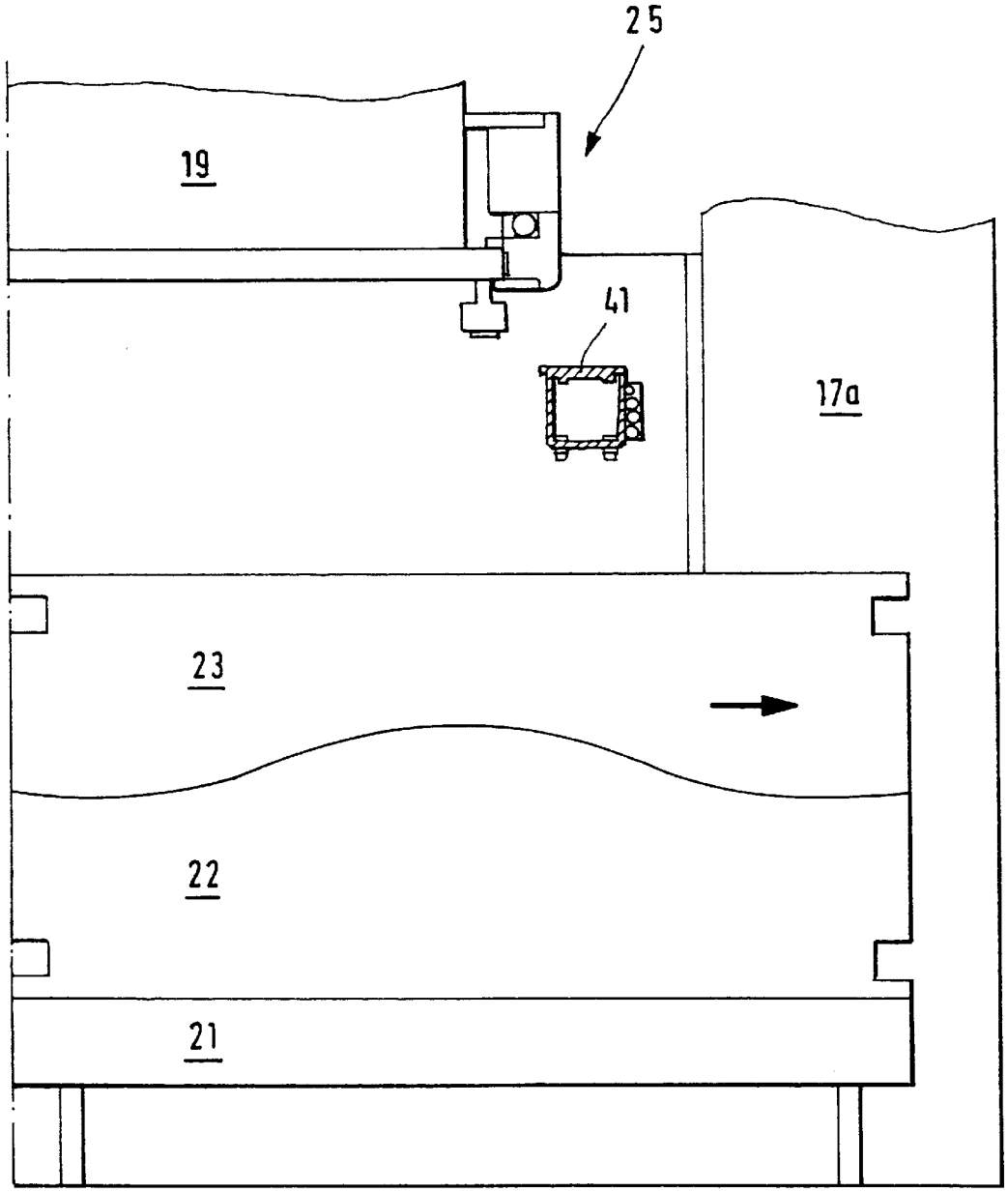

In another step, the slide 19 as well as the transport rail 41 are moved into an upper position, as illustrated in FIG. 10, after which the sliding table 21 with the bottom tool 22, the top tool 23 and the carrier rails 51 received in the receiving device 69 can be moved laterally out of the press station, as outlined schematically in FIG. 11.

Because of the narrow arrangement of the carrier rails 51 in the space, the rails do not project beyond the sliding table 21 although during the operation they span a large area and in particular reach the depositing positions in the column area, and, completely without any problems, pass through the press columns 17*a*, 17*b* indicated in Fig. 1.

If a particular one of the press stations is to be provided with other tools and is to be fitted with gripper devices set up for other workpieces, the above-mentioned steps must be carried out in a reverse sequence. The fitting of the transport rails with carrier rails, like their removal, takes place only by the movement of the transport rails after the receiving device has changed from its storage position into the receiving position.

In summary, a multistation press 1 has a three-axis transfer provided with transport rails 41, 42 onto which carrier rails 51 are placed. The carrier rails 51 carry grippers 53 for the workpieces. During the tool change, the carrier rails 51 are deposited on corresponding receiving devices 69 of the sliding table 21. For this purpose, the transport rail 41 is at first moved such that it deposits a first carrier rail 51 connected therewith on the receiving device 69. Then the transport rail 41 is separated from the carrier rail 51 and is moved to bring a second carrier rail 51 still connected therewith to the receiving device 63. The receiving device 69 is constructed to receive the second carrier rail 51 in the direct vicinity to the first carrier rail 51, in which case the two carrier rails 51 overlap and, at least in principle, are arranged side-by-side at a narrow distance from one another. The receiving device 69 is then laterally swivelled away. The deposition of the carrier rails 51 on the receiving device 69 takes place without the aid of driving devices operating between the transport rail 41 and the carrier rail 51, whereby the construction can be kept simple and the weight of the overall device can be kept comparatively low. This further permits improved dynamics of the three-axis transfer while requiring only moderate driving power.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A multistation press, comprising a plurality of press stations arranged behind one another corresponding to a machining sequence;

sliding tables associated with respective ones of the press stations;

a transfer device for transporting workpieces between the press stations in a transport direction, and having at least two transport rails;

a driving device for driving the transport rails to carry out a transfer movement;

carrier devices detachably connected in a mutually spaced manner with the transport rails and provided with gripper devices; and at least one receiving device provided on the sliding table and arranged for connecting with the carrier devices, and for holding at least two separate carrier devices in spaced relationship to one another, wherein the carrier devices have a smaller distance from one another with respect to the distance between the transport rails.

2. The multistation press according to claim 1, wherein the receiving device is operatively arranged such that the carrier devices carried by the receiving device overlap at least in sections in the transport direction.

3. The multistation press according to claim 1, wherein the receiving device is configured such that the carrier devices received thereby are parallel and held one of next to one another and above one another.

4. The multistation press according to claim 1, wherein each of the carrier devices has a height which is lower than the height of the transport rail.

5. The multistation press according to claim 1, wherein the carrier devices are configured to effect longitudinal adjustment relative to the transport rail in the absence of driving devices.

6. The multistation press according to claim 1, wherein the carrier device is held by a form-locking coupling device on the transport rail which, via a relative movement of the transport rail is engageable and disengageable with respect to the carrier rail.

7. The multistation press according to claim 1, wherein the carrier device is lockable on the transport rail via a locking device.

8. The multistation press according to claim 1, wherein the receiving device is form-lockingly coupled with the carrier device.

9. The multistation press according to claim 8, wherein the carrier device is stationarily held with respect to the transport direction via form-locking coupling with the receiving device.

10. The multistation press according to claim 7, wherein the form-locking coupling device arranged to act between the carrier device and the transport rail is configured to be in a release position when the carrier device is form-lockingly connected with the receiving device.

11. The multistation press according to claim 1, wherein the receiving device is arranged to be swivellable by a swivel device about an axis situated parallel to the transport direction and is disposed on the sliding table to be movable in transverse and the vertical directions relative to the transport direction.

12. The multistation press according to claim 11, wherein the swivel device is configured such that the transport rail is bringable into a first swivelling position in which the carrier device is engaged with and disengaged from the receiving device, and is changeable into a second swivelling position in which the transport rail is unimpairedly adjustable in the vertical direction.

13. The multistation press according to claim 1, wherein the transport rails are arranged along the transport direction in a common plane and are moveable by the driving device at least in the transport direction and perpendicularly with respect to the common plane.

14. The multistation press according to claim 13, wherein the transport rails are configured to be moveable toward one another and away from one another.

15. The multistation press according to claim 13, wherein the driving device has a separate unit for movement of the transport rails in the transport direction, and at least one driving unit separated therefrom to provide the transport rails with a lifting and lowering movement as well as an opening and closing movement.

* * * * *